United States Patent [19]

Outlaw

[11] 4,084,555

[45] Apr. 18, 1978

[54] RADIAL ENGINE

[76] Inventor: Homer G. Outlaw, 1824 Nie Pkwy., New Orleans, La. 70114

[21] Appl. No.: 697,531

[22] Filed: Jun. 18, 1976

[51] Int. Cl.[2] ..... F02B 75/26

[52] U.S. Cl. ..... 123/58 AA; 418/123; 418/129; 418/101; 123/58 AB

[58] Field of Search ..... 123/58 R, 58 A, 58 AA, 123/58 AB, 58 AM, 58 C, 43 A, 43 AA, 43 C; 418/123, 129

[56] References Cited

U.S. PATENT DOCUMENTS

| | | | |
|---|---|---|---|
| 793,270 | 6/1905 | Blomgren | 123/58 A |
| 2,439,265 | 4/1948 | Schroeder | 123/58 AB |
| 3,687,117 | 8/1972 | Panariti | 123/58 AM |
| 3,873,250 | 3/1975 | Batten | 418/123 |
| 3,895,614 | 7/1975 | Bailey | 123/58 A |

FOREIGN PATENT DOCUMENTS

| | | | |
|---|---|---|---|
| 2,213,807 | 9/1973 | Germany | 123/58 R |

*Primary Examiner*—Clarence R. Gordon
*Attorney, Agent, or Firm*—John W. Huckert

[57] ABSTRACT

A radial engine having an engine casing supporting for rotation therein a central drive shaft and having mounted thereupon a rotator drivingly afixed to said shaft, at least two combustion apertures provided along the circumferential edge of the rotator and in alignment with complimentary apertures provided within the engine block for mating with said rotor apertures. At least two axially reciprocal pistons for compressing the fuel within said engine combustion chambers, at least one intake valve with each combustion chamber, and a slotted piston cam drivingly engaged on said central shaft and associated by cam follower mechanism with said reciprocal pistons. Appropriate exhaust ports are provided within the engine block and spaced at least a rotor combustion chamber width away from the combustion chambers and in alignment with the combustion chambers in said rotator. Intake valve cam structure also appropriately arranged for drive from the central shaft. Also this device incorporates a unique combustion chamber sealing compression ring of spring loaded type, relief channel structure associated with the combustion chamber in the rotator, and oil scraper structure.

8 Claims, 10 Drawing Figures

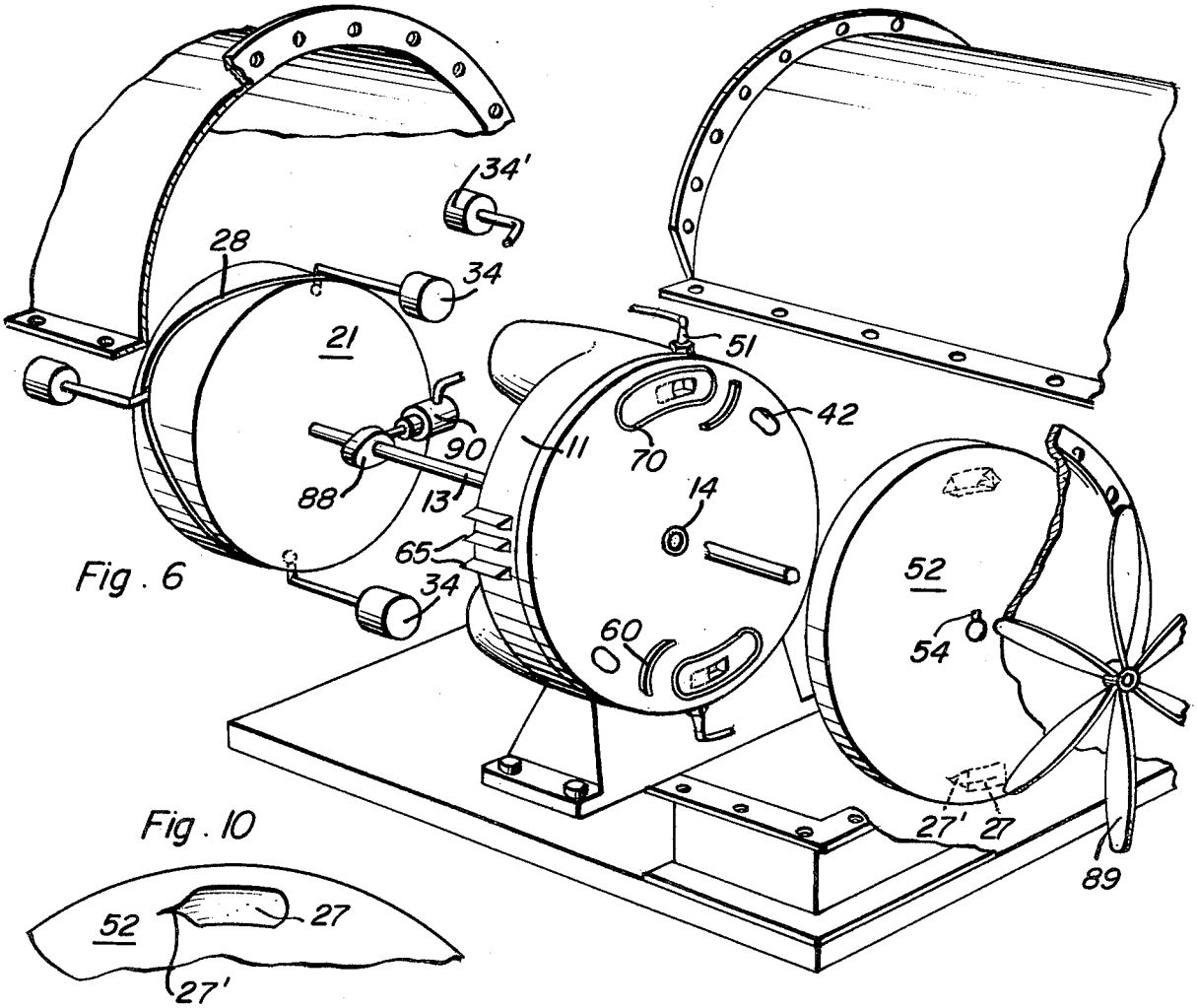
Fig. 6
Fig. 10
Fig. 7
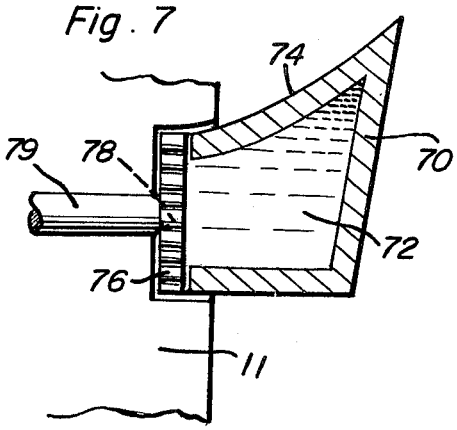
Fig. 8
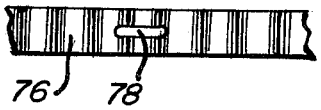
Fig. 9
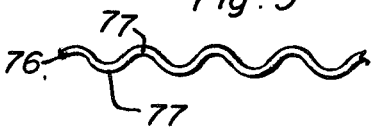

RADIAL ENGINE

BACKGROUND OF THE INVENTION

1. Field of the Invention

This invention relates generally to internal combustion type engines of the radial type and for achievement of improved operating efficiency thereof.

2. Description of the Prior Art

A common problem with known type radial engines are that they are unduly complicated and require numerous parts which greatly increase maintenance and service costs thereof.

Another disadvantage of internal combustion engines of the known type are that they require exhaust valves, timing chains, additional cam shafts, rod bearings, radiators, belts, hoses, and usually create a positive combustion force that is in opposition to the turning drive shaft, i.e. that is they fire before top dead center of the conventional type piston.

Known prior art patents which may be pertinent to this invention are as follows: Ser. Nos., 683,705; 991,933; 1,612,785; 2,084,923; 2,148,312; and 3,857,370.

None of these known prior art devices offers the new and unique features of the invention disclosed herein.

SUMMARY OF THE INVENTION

An object of the present invention is to provide an improved radial type internal combustion engine having relatively few operating parts in order to improve the serviceability and maintenance of same.

Another object of the present invention is to provide a radial engine having a central drive shaft supported within a main engine block, at least two reciprocating pistons mounted within radially positioned and axially extending combustion chambers provided in said block, with said combustion chambers and reciprocating pistons being 180° or diametrically opposite from each other. A single slotted piston cam for effecting reciprocation of the pistons within the combustion chamber is mounted upon said single drive shaft.

A further object of this invention is to provide a radial engine having integral cooling fan structure associated with a central drive shaft together with all the necessary valve actuating cams, oil pump actuating cams, combustion chamber pressure increasing structure necessary for proper operation of said overall engine; all mounted from and driven from the single drive shaft.

A still further object of this invention is to provide a unique oil scraper structure, a compression ring structure associated therewith to retain compression and compression force within the proper combustion chambers, and relief channel provided within the combustion chamber of the radial engine rotator all for the purpose of achieving more effective and efficient operation.

The improved radial engine of this invention fires twice in one revolution of the drive shaft while a standard internal combustion engine fires once in every two revolutions of the crank shaft. This together with the fact that far fewer parts are necessary for the entire operating engine structure accounts for one of the great advantages over conventional type internal combustion engines.

The engine is also readily adaptable for adding additional banks of combustion chambers and rotators thereto to increase the overall total efficiency and power of the engine structure. As long as the engine combustion chambers are properly balanced any number of same may be provided and any number of stages thereof may be utilized to increase the overall size and power output of the total engine.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 6 is a perspective view of the engine components as disassembled and as may be modified to increase the overall capacity thereof.

FIG. 7 is a greatly enlarged cross-sectional view of a compression ring and ribbon backing spring used therewith taken generally along line 7—7 of FIG. 2.

FIG. 8 is a view of part of the ribbon spring backing for the compression ring as viewed from the side.

FIG. 9 is a top plan view of the spring structure of FIG. 8.

FIG. 10 is a side elevational view of the top portion of the rotator per se as viewed from the left in FIGS. 1, 3 and 6.

DESCRIPTION OF THE PREFERRED EMBODIMENT

Figure 1:
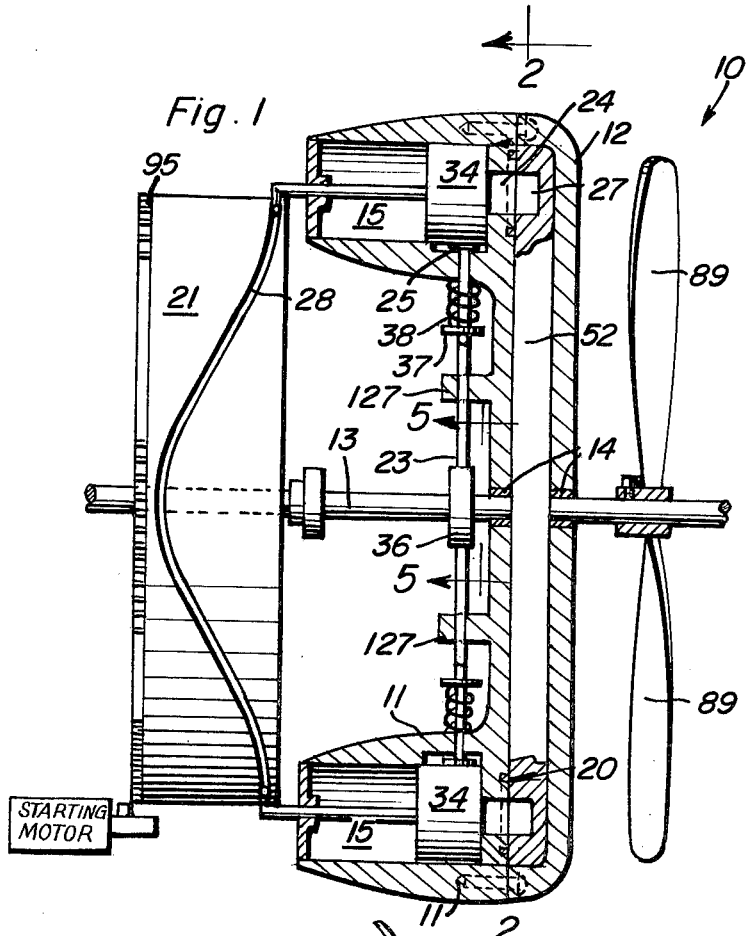
FIG. 1 is a side elevational view, partly in cross-section, of the basic components of this engine.

Referring to FIG. 1 of the drawing, reference numeral 10 indicates, in general, the improved radial engine of this invention. The basic engine block consists of main engine body member 11 having a removable portion 12 attached thereto by conventional means such as bolts and the like. A central drive shaft 13 is rotatably mounted in the center of said engine block by suitable bearing structure 14 indicated in general on the drawing, but not shown or described in detail. Also, drivingly fastened to the main rotatable drive shaft 13 is a slotted piston cam 21. Appropriate support bearing structure may also be provided on the shaft 13 to the left of the piston cam 21 as viewed in FIG. 1, but again such bearing structure would be of conventional nature and is not shown for the sake of clarity of the drawings. The piston cam 21 has provided therein a cam slot 28 of a specific configuration generally as shown in the drawings.

The main engine block 11 also has at least two diametrically opposed combustion chambers 15 formed therewithin. These chambers are formed near the circumference of the overall engine block and are for the purpose to be described below.

Each chamber 15 also has provided near the combustion end thereof, a chamber 24, intake valve structure 25. Appropriately associated with the intake valve 25 are intake ports which connect with conventional type carburetor means for allowing a mixture of air and fuel into the combustion chambers 24 when the valves 25 are open. The valves 25 may be of the free floating type and operate due to the vacuum which is pulled upon the combustion chamber 24 by reciprocation of the piston 34 therewithin, or they may be positively actuated by a valve cam 36 mounted upon the drive shaft 13 for positive rotation therewith. If the valves 25 are operated by a valve cam 36 then appropriate intake valve springs 38 with keeper members 37 thereon will normally be utilized. A valve stem actuator 23 will normally also be provided with appropriate guide structure 127 associated therewith.

Figure 3:
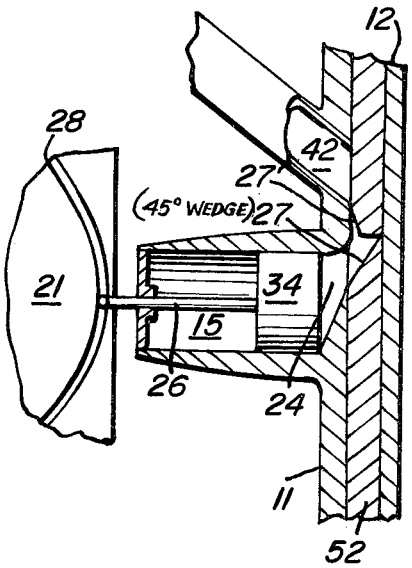
FIG. 3 is a top plan view, in part of the engine block showing the combustion chamber and exhaust port together with a reciprocating piston as mounted therein.
Figure 4:
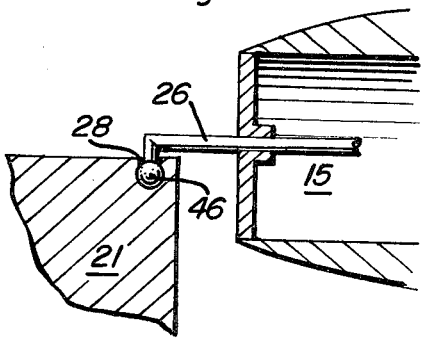
FIG. 4 shows a side elevational view of the piston cam relief channel and piston connecting rod follower of the structure shown in FIG. 3.

The pistons 34 are appropriately connected by means of a cam follower connecting rod 26 to the slotted piston cam. As best seen in FIGS. 3 and 4 this cam follower connecting rod 26 is appropriately connected to the cam groove 28 of the piston cam by a ball-type connection 46. This ball connection 46 is slightly smaller than the cam groove 28 so as to permit a free yet positive actuation of the connecting rod portion 26.

Thus, as can be envisioned by looking at the drawings, as the drive shaft 13 rotates together with the piston cam 21 the configuration of the cam groove 28 is such as shown to cause each piston to reciprocate twice within its respective cylinder for each complete revolution of the drive shaft 13.

Looking at FIG. 3 the combustion chamber 24 at the head of the piston 34 can be clearly seen together with the combustion chamber 27 which is provided in the rotator and in alignment to compliment chamber 24. The respective alignment of these chambers may also be seen in FIG. 6.

FIG. 3 also clearly shows the exhaust passageway 42 as provided within the main engine block and slightly offset from the combustion chambers 24. The offset must be or should be the length of the combustion chamber 27 as provided in the rotator 52.

The rotator 52 is primarily a metal disk of accurately sized dimensions for close fitting engagement within the overall engine block structure. Suitable key or other means 54 may be used to fasten the rotor to the drive shaft 13.

Another feature of the combustion chambers 27 and the rotator 52 are the relief channels 27' provided in communication therewith. This relief channel will allow each combustion chamber 27 within the rotator to receive the mixture of air and fuel somewhat sooner than if the relief channel is not present. This has been discovered to create a very desirable advantage to the overall operation of the device. This relief channel 27' may also be seen in greater detail in FIG. 10 of the drawings.

Figure 2:
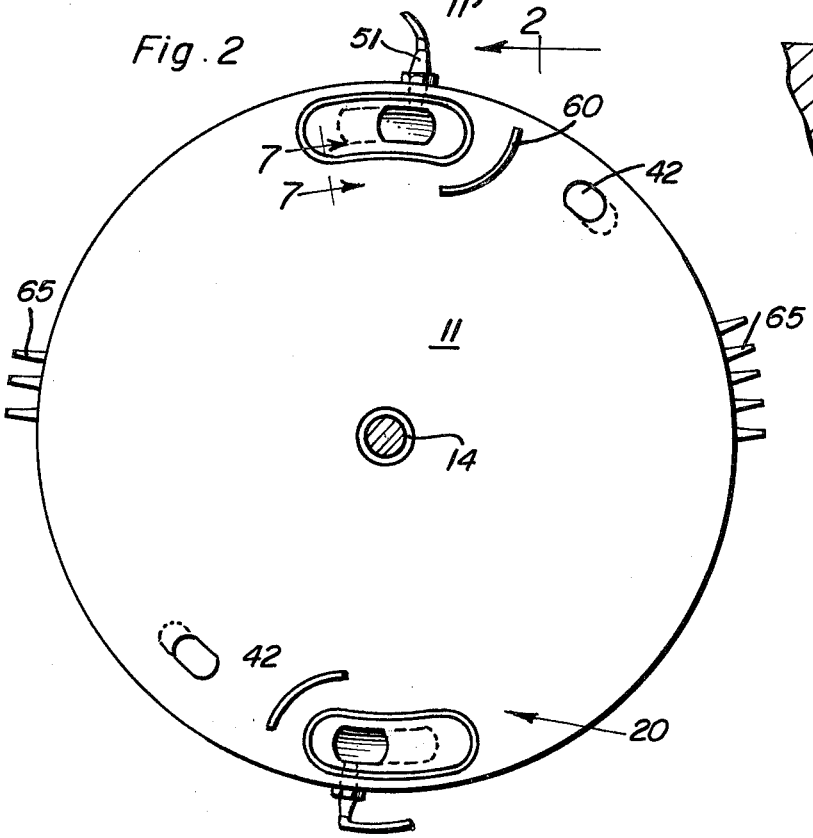
FIG. 2 is a side view of the engine block and combustion chambers therein, taken generally along line 2—2 of FIG. 1.
Figure 5:
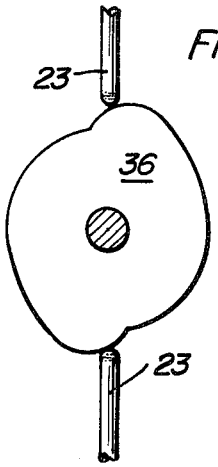
FIG. 5 is a view of the intake valve cam structure taken generally along line 5—5 of FIG. 1.

Spark plugs 51 are also indicated in FIG. 2 of the drawings for providing the ignition of the fuel mixture at the proper time. A conventional type ignition system may be associated with and driven from the engine drive shaft 13 in the well known conventional manner. Also oil scrapers 60 are provided.

Another new and unique feature of this invention is in the compression sealing ring as shown in enlarged detail in FIG. 7. This ring is indicated in FIG. 1 by the reference numeral 20 and is used to effectively seal the inner portion of the combustion chambers 24 and 27 from the rest of the rotator structure. The combustion ring comprises a primary ring member 70 of elliptical shape having a configuration in cross-section like that shown in FIG. 7. Inside of this combustion ring is a central aperture 72 for the flow of oil and a tapered inner portion 74 for facing the interior of the combustion chamber. A ribbon spring 76 maintains pressure on this combustion ring to force same outwardly from the main engine block 11 and against the smooth inner surface of the rotator 52. Since the tapered portion 74 faces inwardly, when combustion does take place there will be a force exerted against this tapered surface which will further force the surface touching the rotator against same to block loss of compression from the combustion chamber. The ribbon spring as seen in FIGS. 8 and 9 will maintain normal spring loading against the combustion ring and against the rotating rotator. The ribbon spring 76 also is provided with undulating portions 77 in order to achieve its spring effectiveness and appropriate oil passage slots 78 to permit oil from the part associated with the engine and through appropriate connecting passageways 79 within the engine block to reach the compression ring.

FIG. 6 of the drawings shows the engine as disassembled and in proper order, and also clearly shows the cam 88 for actuation of an oil pump 90 for the engine.

Another important feature of this engine is in the cooling means used therewith. An assembly of the propeller blade type 89 is appropriately indicated fastened to one or both ends of the drive shaft 13. A single propeller-like blade may be used, but generally it is more effective if a plurality of such blades are mounted upon the shaft.

Appropriate baffeling channels and cast iron or sheet metal work will be used with the basic engine block assembly in order to properly direct the cooling air flow over the engine. Consequently, by using air cooling of this simple direct drive type much complicated structure such as radiators, cooling water passageways in the engine block, connecting hoses and tubing, etc. are eliminated. Cooling vanes 65 may be provided.

Also, in the view of FIG. 6 the ease of doubling or duplication of the basic engine structure may be visualized. As shown, the second plurality of reciprocating pistons 34' may be added and driven from the same single slotted piston cam 21. A duplicate engine block, rotator, and other duplicate structures would be appropriately provided on the other side of the cam block to increase or double the overall engine output of the drive shaft 13. The second bank of cylinders and reciprocating pistons normally would be placed at right angles or 90° offset to the first bank of cylinders. This will give a combustion every 90° with a total of 8 combustions in one revolution of the drive shaft. Since the driving force is all in the same direction you can put an infinite number of engines on one common drive shaft without any worry of synchronization or related problems.

One can also vary the travel of the piston as driven by the slotted piston cam by varying the size of the piston and/or the size of the combustion chamber depending on the desired compression ratio. Gear 95 on cam 21 may be used for starting.

The foregoing is considered as illustrative of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An internal combustion engine comprising; an engine block having at least one combustion chamber therein, means for inducting an air/fuel mixture into the engine block combustion chamber, means for igniting said mixture therein, and means for exhausting the combustion produsts thereof, a drive shaft, a rotator affixed to said drive shaft, additional means for increasing the compression of the fuel/air mixture within said combustion chamber, further means for sealing the space between the combustion chamber within the engine block and the rotator as it passes adjacent the combustion chamber, the additional means including a piston cylinder connecting with the combustion chamber in the engine block, and a reciprocating piston contained within the piston cylinder functions to increase the compression thereof, actuating means connected to said piston for effecting said increase in compression at least twice for each revolution of the drive shaft, the actuating means including a drum cam having a specially configured cam slot on the outer surface thereof in order to effect the aforesaid function, with a cam follower connected between the piston and the cam slot, the further means consists of an oval shaped compression ring mounted in an oval shaped recess in the engine block, the compression ring having a tapering concave surface facing inwardly towards the combustion chamber and a smooth flat outer face which engages with the rotator, so that an increase in compression within the combustion chamber will increase the sealing action of the compression ring.

2. The structure as set forth in claim 1, wherein the further means also includes a ribbon spring backing the compression ring and arranged between said ring and the engine block to effectively bias the ring against the rotating rotor, oil slots provided in said ribbon spring to permit the passage of oil into the interior of the compression ring, and appropriate oil passageways provided in the engine block to feed oil thereto.

3. The structure as set forth in claim 2, together with an oil scraper member on the engine block appropriately spaced a short distance from the combustion chamber, and a relief channel provided in the rotator to permit the filling of a combustion chamber contained therein prior to actual alignment of said rotator combustion chamber with the engine block combustion chamber.

4. The structure as set forth in claim 3, wherein the means for inducting a fuel/air mixture into the combustion chamber includes an intake valve mounted in an appropriate intake passageway, and a cam mounted on the drive shaft for actuation of said intake valve in proper timing with the drum cam, and another cam provided on the drive shaft to operate an oil pump for the engine oil pressure.

5. The structure as set forth in claim 4, wherein a cooling fan is mounted on at least one end of the drive shaft to provide cooling airflow over the engine block.

6. The structure as set forth in claim 5, wherein cooling vanes are provided on the external surface of the engine block to substantially increase the cooling thereof, and a starter gear is provided integral with the drum cam.

7. The structure as set forth in claim 6, wherein at least two combustion chambers are provided in the engine block, at least two corresponding combustion chambers are provided in the rotator, said combustion chambers in both the engine block and the rotator are diametrically opposite each other, and the combustion chambers in the rotator have a 45 degree wedge shape configuration thereto.

8. The structure as set forth in claim 7, wherein a second complete engine and rotator structure similar to the aforesaid structure is mounted upon the other end of the drive shaft from the first engine structure, and operated from the single drum cam as arranged between the two engine blocks for the purpose of substantially doubling the output power.

* * * * *